United States Patent [19]

Caston

[11] Patent Number: 5,020,899

[45] Date of Patent: Jun. 4, 1991

[54] HAND GRIP FOR A SEQUENTIAL CARD PACK DISPLAY DEVICE

[76] Inventor: Hoite C. Caston, 3589 Multiview Dr., Hollywood, Calif. 90068

[21] Appl. No.: 449,763

[22] Filed: Dec. 13, 1989

[51] Int. Cl.[5] ..... G03B 25/00

[52] U.S. Cl. ..... 352/99; 352/243

[58] Field of Search ..... 352/98, 99, 243

[56] References Cited

U.S. PATENT DOCUMENTS

| | | | |
|---|---|---|---|
| 258,164 | 5/1882 | VanHoevenbergh | 352/99 |
| 865,593 | 9/1907 | Jenkins | 352/99 |
| 2,949,838 | 8/1960 | Skalabrin | 352/243 |
| 3,453,746 | 7/1969 | Cartwright | 352/99 |
| 3,593,432 | 7/1971 | Reynolds | 352/99 |

FOREIGN PATENT DOCUMENTS

| | | | |
|---|---|---|---|
| 627770 | 3/1936 | Fed. Rep. of Germany | 352/99 |
| 407598 | 1/1910 | France | 352/99 |

*Primary Examiner*—Monroe H. Hayes
*Attorney, Agent, or Firm*—N. J. Aquilino

[57] ABSTRACT

A hand grip for a sequential card pack display device formed of a pair of elements structured to hold one end of the card pack, and including a plurality of contoured depressions on the upper surface to accommodate the fingers of a user to facilitate sequencing of the pictures to provide an illusion of motion.

7 Claims, 1 Drawing Sheet

HAND GRIP FOR A SEQUENTIAL CARD PACK DISPLAY DEVICE

BACKGROUND OF THE INVENTION

The present invention relates to a sequential card display device, and in particular to a sequential card display device having an improved hand grip to facilitate manipulation of the individual cards.

Sequential card display devices have been known for some time wherein a series of pictures of sequential movements of a body in motion are shown to provide an illusion of motion. The pictures are mounted in a hand held display card package and the pictures are sequenced by flipping them picture by picture, with the fingers. Display devices of this type have been used for amusement and for educational purposes. By using a series of still frame pictures of incremental movements of a body in motion, one is able to study in detail the various movements of the body, and also is able at any time to stop the sequential movement of the pictures to study, in detail, an individual picture showing a particular movement of the body in motion at any given time.

For example, display devices of these types lend themselves particularly well to sporting pictures where movement provides an entertaining or educational visual effect. The swinging of a golf club or the batting or throwing of a baseball are examples which are particularly adaptable for these types of visual displays.

The key to maximum visual enjoyment, or learning the movement of the body in motion, lies in being able to precisely sequence the cards in exact order, one after another in a timed sequence, so that a smoothly flowing illusion of motion is provided. In order to do this, the cards are generally gripped either by the bottom or top or either side, normally at a point where they are attached together, and sequenced using the fingers and the thumb to flip one picture card after another in order.

The present invention provides a unique grip device which is attached to one end of a stack of a plurality of sequential display cards thereby holding the cards together, and in a precise oriented relationship; and secondly, the grip provides a contoured surface at the top and on each of the ends to accommodate the fingers and/or thumb of the user.

Whereas all previous sequential card display devices have required the use of two hands to operate them, by the use of this grip such a device can, for the first time, be operated by one hand, thus freeing the other hand to simultaneously practice or perform the action being depicted in the series of pictures of sequential movements.

The grip is formed of two mating elements, each having an end grip, a side wall and one-half of a contoured top gripping surface. Joining pins are provided to precisely align the two mating elements to ensure that the top grip surface forms a smooth, contoured structure to facilitate the engagement user's fingers and thumb. The inner wall of each of the gripping elements is provided with paper spikes which aid in gripping the pack of display pictures.

It is an object of the present invention to provide a sequential card pack display device having an improved gripping device to hold the series of display cards in precise alignment, and to facilitate the sequencing of the individual card pictures using the fingers and thumb while maintaining a secure grip on the device.

This and other objects will become more apparent with reference to the following drawings and accompanying specification.

DESCRIPTION OF THE PREFERRED EMBODIMENTS

Figure 1:
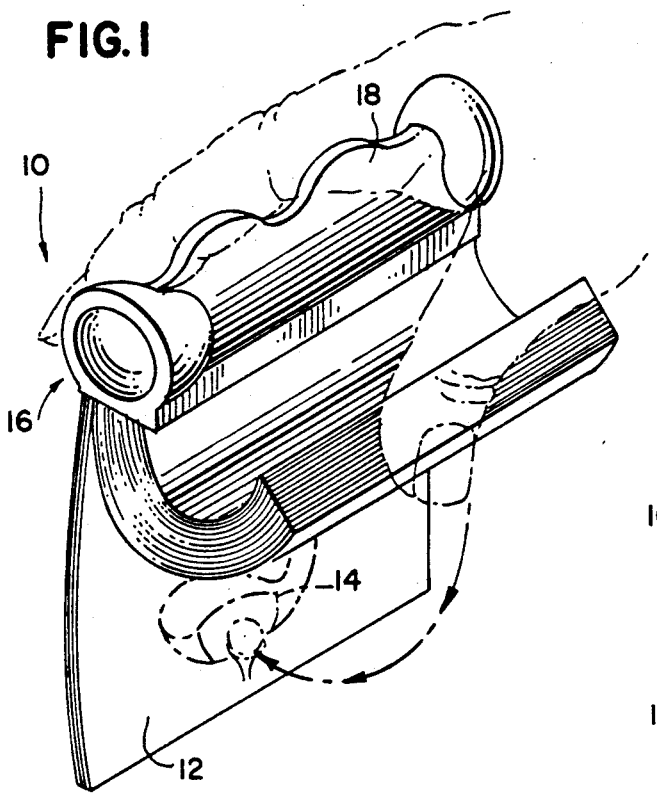
FIG. 1 is a perspective view of the present invention showing the device as it would appear during a picture sequencing operation.
Figure 2:
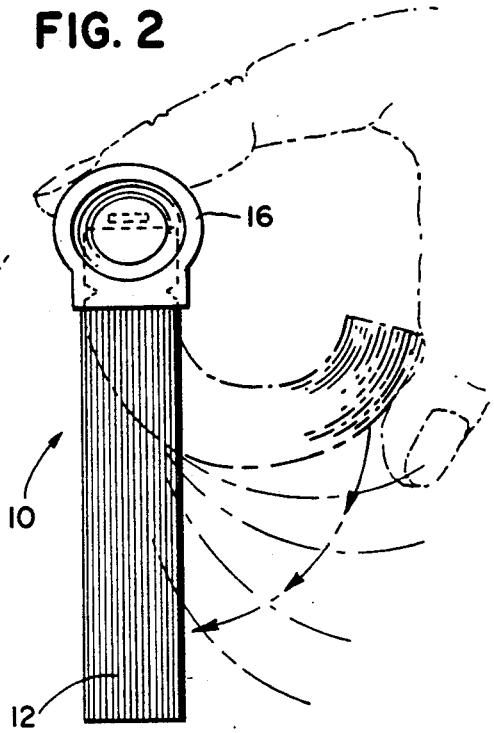
FIG. 2 is a side view of FIG. 1.
Figure 3:
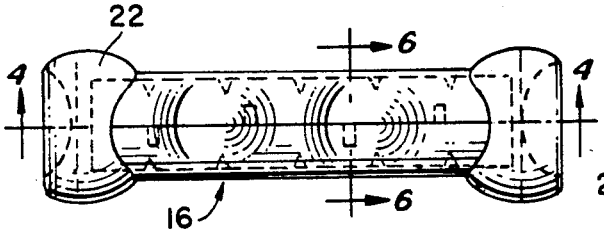
FIG. 3 is a top view of the grip member.
Figure 4:
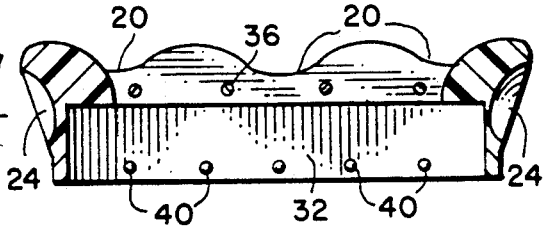
FIG. 4 is a side sectional view of the grip member taken along the lines 4—4 of FIG. 3.

Referring to the drawings, FIG. 1 illustrates a sequential card pack display device 10 formed of a plurality of individual picture cards 12, each having a sequential picture 14 of a body in motion as, for example, a golf club swinging and hitting a golf ball. One end of the pack of picture cards is secured by a grip member 16 formed of an upper contoured surface 18 having a plurality of finger engaging grooves 20, and which includes end members 22, each also including finger or thumb detents 24.

Figure 5:
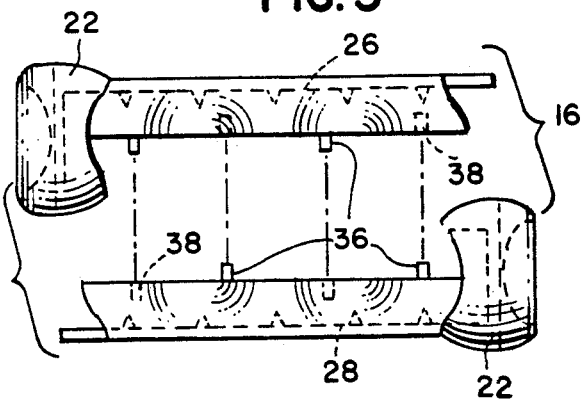
FIG. 5 is an exploded view of the grip member.
Figure 6:
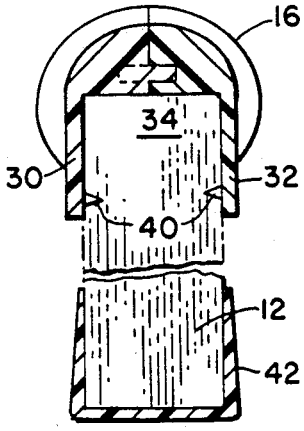
FIG. 6 is an end sectional view taken along the lines 6—6 of FIG. 3.

The hand grip element 16 is formed of two separate halves 26 and 28, as shown in FIG. 5, and further includes side wall members 30 and 32 which extend downwardly from the upper surface 18 forming a chamber 34 structured to accommodate the ends of the card picture pack. Each of the elements 26 and 28 are provided with joining pins 36 which cooperate with and fit into corresponding holes 38 on the opposite sides of each opposing member. The pins 36 and holes 38 ensure that the separate elements fit together precisely to provide a smooth, contoured upper surface 18 for placement of the user's fingers in the grooves 20. Each of opposite sides of the inner wall members 30 and 32 are provided with paper engaging spikes 40 which securely grip the card picture pack, thereby holding it together, and in precise alignment to facilitate the sequential movement of each of the individual picture cards with respect to each other to provide the illusion of movement.

When not in use, the device may be provided with a clip 42 to protect the bottom edges of the picture card pack preventing them from being bent, or otherwise worn, thereby diminishing the usability of the device.

It will be appreciated that modifications may be made to the above structure in keeping within the scope of the following claims.

I claim:

1. In combination with a card pack display device including a plurality of pictures showing a series of incremental movements of a body in motion, the pictures being connected together at one end thereof, the opposite end of said pictures being flexible to permit a user to flip the said opposite end with the fingers for sequential viewing of said pictures to produce an illusion of motion wherein the improvement comprises:

a grip device attached to said one end of said card pack display device characterized by a plurality of contoured depressions on said upper surface to accommodate the fingers of a user to facilitate the flipping of the cards by the fingers.

2. The display device of claim 1 wherein said grip has three finger receiving contoured depressions.

3. The display device of claim 2 wherein said grip further includes a contoured depression on each end thereof.

4. The display device of claim 1 wherein said grip includes two opposing and complementary interconnectable grip elements; said elements, when in an interconnected position, include walls forming a chamber structured to receive said one end of said card pack display device; and having means for aligning said elements in said interconnected position.

5. The display device of claim 4 wherein said aligning means are pins on one of said grip elements and complementary holes in the other of said grip elements.

6. The display device of claim 4 further including auxiliary gripping means for holding said card pack display pack.

7. The display device of claim 6 wherein said auxiliary gripping means are spike elements attached to said interior walls and projecting outwardly therefrom.

* * * * *